US005318173A

United States Patent [19]

Datari

[11] Patent Number: 5,318,173

[45] Date of Patent: Jun. 7, 1994

[54] HOLE SORTING SYSTEM AND METHOD

[75] Inventor: Srinivasa R. Datari, Medford, Oreg.

[73] Assignee: Simco/Ramic Corporation, Medford, Oreg.

[21] Appl. No.: 890,967

[22] Filed: May 29, 1992

[51] Int. Cl.[5] ..... B07C 5/342; B07C 5/00

[52] U.S. Cl. ..... 209/580; 209/587; 209/639; 209/939; 382/8; 382/28; 348/125; 348/91

[58] Field of Search ..... 209/576, 577, 580, 581, 209/582, 587, 939, 639; 382/8, 18, 23, 28, 54; 358/106

[56] References Cited

U.S. PATENT DOCUMENTS

| | | | |
|---|---|---|---|
| Re. 33,357 | 9/1990 | Randall | 358/106 |
| 4,271,968 | 6/1981 | Mehrkam et al. | 209/581 X |
| 4,368,462 | 1/1983 | Crawley | 382/54 X |
| 4,493,105 | 1/1985 | Beall et al. | 382/21 |
| 4,493,420 | 1/1985 | Dennis | 209/587 |
| 4,581,762 | 4/1986 | Lapidus et al. | 382/23 X |
| 4,626,677 | 12/1986 | Browne | 209/580 X |
| 4,963,035 | 10/1990 | McCarthy et al. | 382/28 |
| 5,085,325 | 2/1992 | Jones et al. | 209/580 |
| 5,090,576 | 2/1992 | Menten | 209/587 |

FOREIGN PATENT DOCUMENTS

| | | | |
|---|---|---|---|
| 0246243 | 6/1987 | Fed. Rep. of Germany | 382/28 |

OTHER PUBLICATIONS

"Image Processing Algorithms for Industrial Vision", Gerald J. Agin, SRI International, Feb. 9, 1979.

"Vision Mocule User's Guide", Gerald J. Agin and Dennis F. McGhie, SRI Artificial Intelligence Center, Feb. 1979, pp. 1, 5, and 16–21.

"The Vision Module Sets Its Sight on Sensor-controlled Manipulation and Inspection", Gerald J. Gleason and Gerald J. Agin, Robotics Today, Winter 1980–81, pp. 36–40.

*Primary Examiner*—D. Glenn Dayoan
*Assistant Examiner*—Tuan N. Nguyen
*Attorney, Agent, or Firm*—Stoel, Rives, Boley, Jones & Grey

[57] ABSTRACT

An apparatus and a method sort items, such as pickles, having defective shapes, such as holes. A video camera scans moving items and acquires lines of image data including item-colored data and background-colored data. The lines of image data are sent to an image processor and compiled into a 64 line "frame" of image data that are further processed to identify the coordinates of individual items and to compute the size of each item. Because holes in an item are the same color as the background color, the invention provides a device differentiating holes from the background. A "hole-bounding box" is scaled to fit within the item position coordinates. The number of background-colored pixels inside the hole-bounding box is computed and compared to a user-defined threshold number. An item is classified as defective if the threshold number is exceeded. Whenever the image processor classifies an item as defective, centroid position coordinates of the item are reported to a master processor for subsequent rejection of the item.

12 Claims, 3 Drawing Sheets

HOLE SORTING SYSTEM AND METHOD

TECHNICAL FIELD

This invention relates to agricultural product inspection and sorting systems and more particularly to photo-optical apparatus and methods for improved sorting of defective items from acceptable items previously inspected in an optical inspection zone.

BACKGROUND OF THE INVENTION

There have been previously known apparatus and methods for sorting defective items from acceptable items by using machine vision techniques. In the agricultural product inspection industry, the definition of a defective item varies from product to product. For example, a black spot on a potato chip or brown rot on a green bean are considered defects. The above defects are characterized by imperfections in the color or texture of the item. In the pickle processing industry, one common defect is characterized as a pickle with a hole or a slit in the middle. This kind of defect results in imperfections in the shape, rather than the color of the item.

Existing methods for removing defects in food products rely on color or texture to classify defects. For example, U.S. Pat. No. 5,085,325 of Jones et al. for COLOR SORTING SYSTEM AND METHOD, assigned to the assignee of the present invention, describes a sorting system having a color camera for inspecting items as they are moved or propelled through an inspection zone by a conveyor belt. Color video data from the camera are digitized and used to address a lookup table containing criteria representing acceptable and rejectable colors. When an item including a defective color is detected by the camera, the location of the defect is stored in a memory for subsequent rejection downstream of the camera. Conveyor belts typically move with sufficient speed to propel items off the end of the belt where a bank of air ejectors, triggered in response to stored defect data, are positioned to deflect defective items toward a rejection conveyor, while allowing acceptable items to fly undeflected toward an acceptance conveyor. Such a system is quite effective at sorting items based on the color and size of defects, but cannot detect unacceptably shaped articles having an otherwise acceptable color.

In another example, U.S. Pat. No. Re. 33,357 of Randall for OPTICAL INSPECTION APPARATUS FOR MOVING ARTICLES, describes a system for inspecting and cutting defects from french fried potatoes and other elongated articles. In the system of Randall, video data representing grey-scale levels corresponding to light levels reflected from items being inspected are digitized and presented to shade detectors, one for light shade defects and one for dark shade defects. Counters accumulate the number of consecutive light and/or dark shade defects detected to determine the size of such defects. When preset size thresholds are exceeded, the defect is excised from the item by a rotary cutter knife. Such a system is capable of differentiating between certain large, light shade defects and certain small, dark shade defects, but cannot detect background-colored shade defects such as holes.

What is needed, therefore, are an apparatus and a method for classifying shape related defects, such as holes of predetermined sizes.

SUMMARY OF THE INVENTION

An object of this invention is, therefore, to provide an apparatus and a method for classifying in specimen items shape related defects such as holes having predetermined sizes and colors.

Another object of this invention is to automatically scale a shape detection threshold to the size of the item being inspected.

A further object of this invention is to facilitate the inspection and sorting of items having both holes and defects.

The present invention is an apparatus and a method for sorting items, such as pickles, some of which have defective shapes, such as holes. A video camera scans moving items and acquires lines of image data including item-colored data and background-colored data. The lines of image data are sent to an image processor and compiled into a 64-line "frame" of image data which is further processed to identify the coordinates of each item and compute its size. Because holes in an item are the same color as the background color, the present invention provides means of differentiating holes from the background. A "hole-bounding box" is scaled to fit within the item coordinates. The number of background-colored pixels inside the hole-bounding box is computed and compared to a user-defined threshold number. An item is classified as defective if the threshold number is exceeded. Whenever the image processor classifies an item as defective, centroid coordinates of the item are reported to a master processor for subsequent rejection of the item.

Additional objects and advantages of this invention will be apparent from the following detailed description of a preferred embodiment thereof which proceeds with reference to the accompanying drawings.

DETAILED DESCRIPTION OF PREFERRED EMBODIMENT

Figure 1:
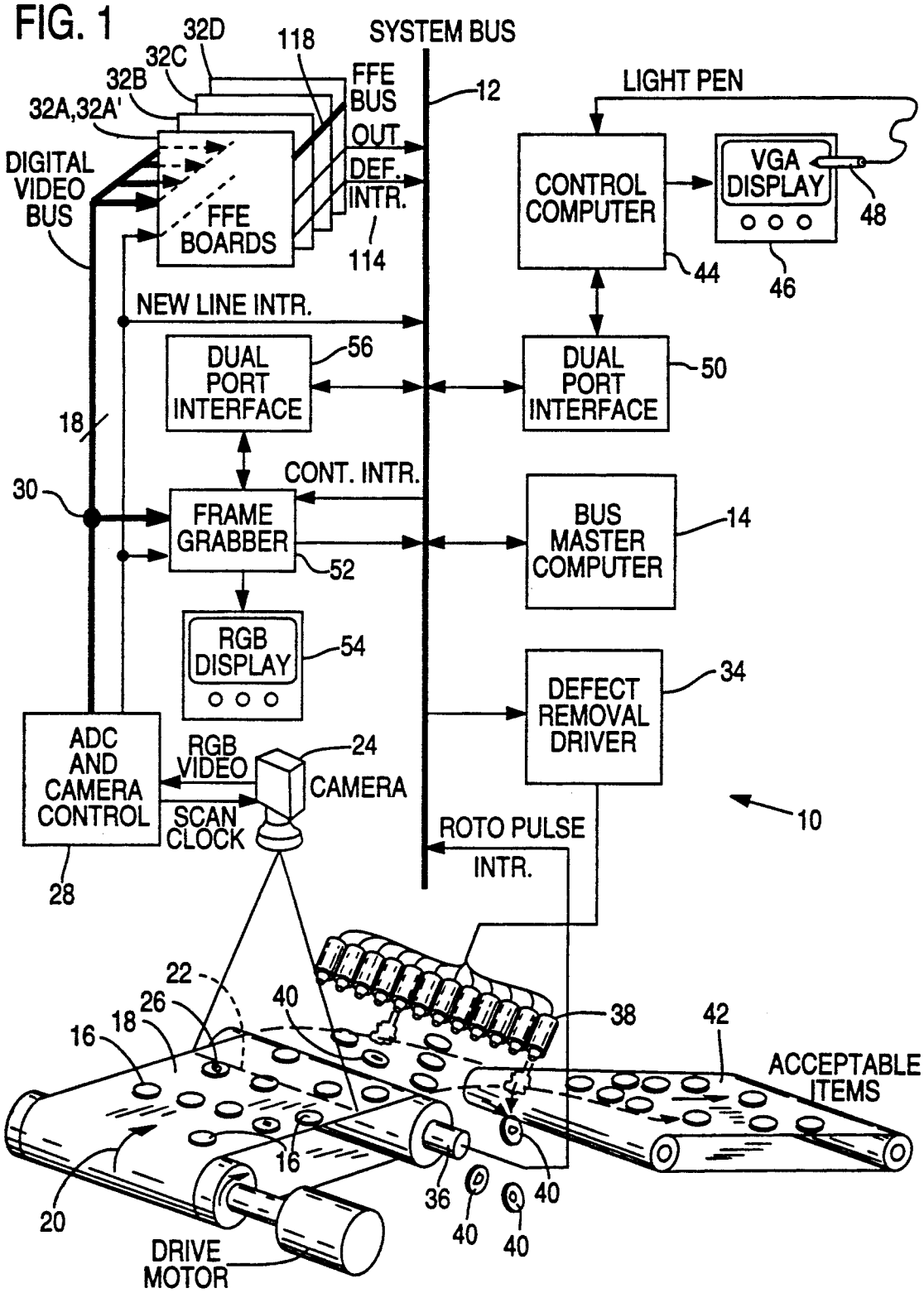
FIG. 1 is an overall system-level block diagram of a sorting system according to this invention, including a pictorial diagram of items being conveyed, inspected, and sorted.

Referring to FIG. 1, an inspection and sorting system 10 includes electronic analysis and control boards embedded on a system bus 12, which is preferably an industry standard VME bus. A bus master Computer 14 based on an Intel® 386 microprocessor serves as controller of the boards embedded on system bus 12.

In operation, items 16 are randomly scattered on a conveyor belt 18 and moved in the direction of arrow 20 through an inspection zone 22 positioned transversely across conveyor belt 18. Inspection zone 22 is defined by the field of view of a line scanning CCD array camera 24 that is shown scanning items 16 one of which includes a defect 26. Camera 24 generates red, green, and blue analog pixel signals which are sent to an analog-to-digital converter and camera control ("ADC") board 28. The analog pixel signals each have amplitudes that are proportional to the amount of radiation received by three arrays of CCD transducers sensitive to predetermined bandwidths of radiation, preferably centered on frequencies of red, green, and blue light. Camera 24 generates analog pixel signals in response to radiation spanning the entire visible spectrum of light but is not limited to the visible spectrum. Each color analog pixel signal is digitized to 8-bits and normalized via conventional gain-RAM and digital multiplier techniques. The two least-significant bits of each digitized pixel signal are discarded, and the resulting three 6-bit digital pixel data signals are concatenated to form an 18-bit wide stream of digital video words, one word corresponding to each pixel position of each scan of line scanning CCD array camera 24. The 18-bit digital video words are placed on a digital video bus 30 for analysis and processing to be described later.

During inspection of items 16 by camera 24, the video data containing defect 26 are placed on digital video bus 30 by ADC board 28. A set of find, filter, and eject ("FFE") boards 32A, 32B, 32C, and 32D (collectively, "FFE boards 32") processes the digital video and generates defect lists that are mapped by master computer 14 into ejector patterns. Bus master computer 14 places the ejector patterns in a memory queue, and in response to roto-pulses from an incremental shaft encoder 36 coupled to conveyor belt 20, the queue is advanced. By the time an item 16 having a defect 26 has traveled from inspection zone 22 into the path of at least one of multiple ejector modules 38, the matching ejection pattern has been advanced to the end of the queue and sent to a defect removal driver board 34. A defective item 40 is subsequently deflected by a blast of air from the appropriate ejector module or modules 38. Acceptable items 16 pass undeflected through the region of ejector modules 38 and land on an acceptance conveyor belt 42 or some other collecting means.

In an alternate embodiment of this invention, inspection zone 22 of camera 24 is displaced downstream from conveyor belt 18 but ahead of ejector modules 38. This embodiment, referred to as "off-belt inspection" allows camera 24 to scan items 16 as they are propelled in the air from the end of conveyor belt 18 toward ejector modules 38. Off-belt inspection allows mounting camera 24 below items 16; such camera positioning is beneficial for inspection of certain kinds of items. Off-belt inspection provides a predictable background color for inspection that prevents dirt and contaminants on conveyor belt 18 from causing anomalous video signals that could lead to sorting errors.

Operator interface to inspection and sorting system 10 is accomplished by means of a control computer 44 including a VGA display 46 and a light-pen 48. Control computer 44 is preferably a PC-AT in which light-pen 48 provides a graphical operator interface for system setup, commands, and parameter adjustments. Control computer 44 communicates with bus master computer 14 over system bus 12 via a 32-kilobyte dual-port interface memory 50. Bus master computer 14 either executes various light-pen selected commands or relays these commands to other devices on system bus 12. Control computer 44 includes a hard disk for storing operator selected setup parameters, product defect histograms, and other initialization data.

A frame grabber board 52 captures sequential words of digital video data from digital video bus 30 and builds up full-color images of items 16 on belt 18 that are displayed on an RGB monitor 54. The operator uses light-pen 48 to select colors displayed on RGB display 54 that represent acceptable items 16, defects 26, and conveyor belt 18. The selected colors are transferred from frame grabber 52 through a dual-port interface 56 to FFE boards 32 by bus master computer 14. The selected colors are used to load color lookup tables on FFE boards 32 with data for determining whether items 16 are acceptable or rejectable. The above-mentioned U.S. Pat. No. 5,085,325 of Jones et al. describes various methods of loading color lookup tables with accept/reject and other data.

Figure 2:
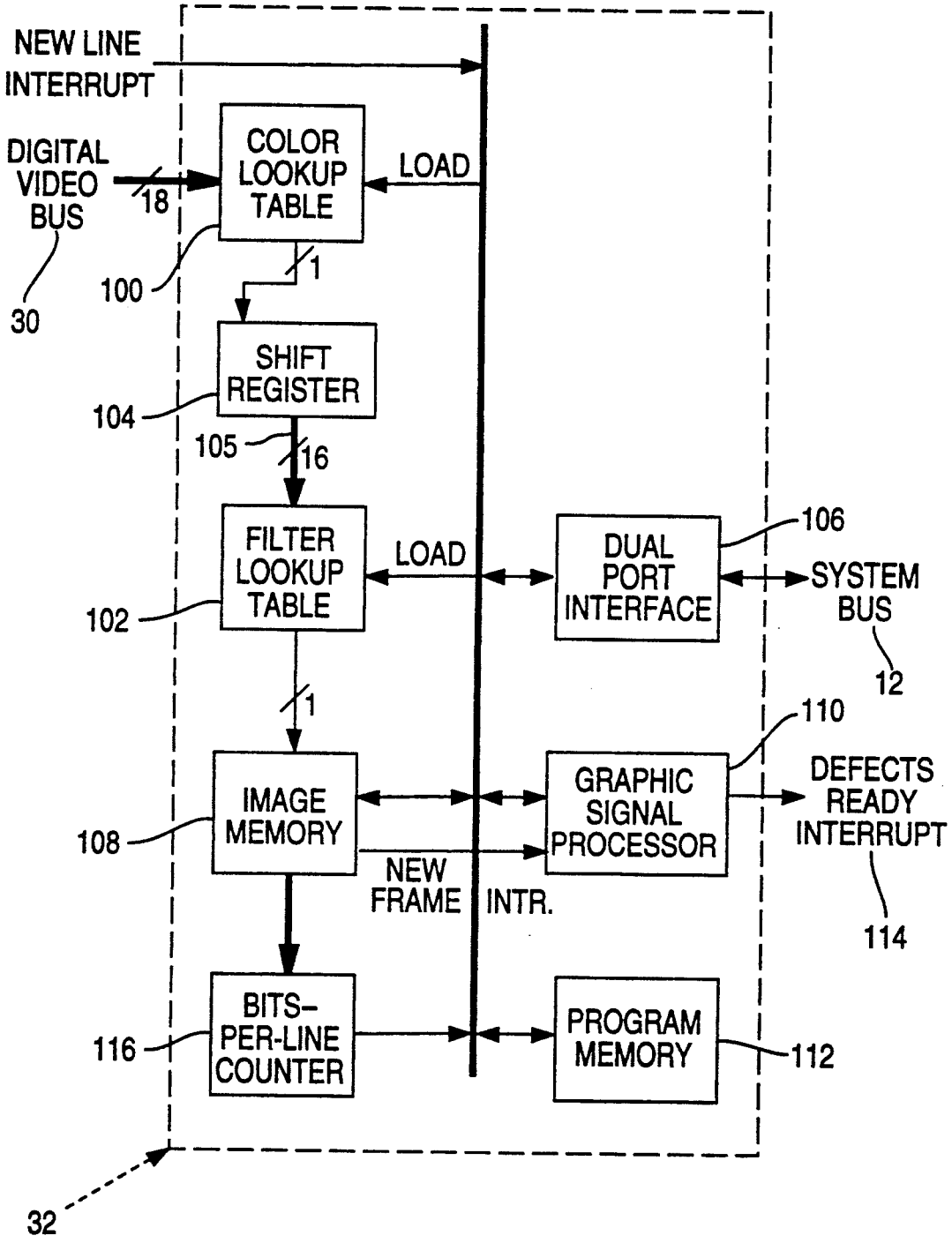
FIG. 2 is a functional block diagram of a find, filter, and eject ("FFE") circuit board according to this invention.

Digital video data are transferred from ADC board 28 to FFE boards 32 on digital video bus 30. Referring to FIG. 2, FFE boards 32 are multi-purpose image analysis boards, each including a color lookup table ("CLUT") 100 containing accept/reject data loaded according to the above description. The 18-bit words on digital video bus 30 act to address CLUT 100, which has an address space of 262,144 locations to accommodate all possible combinations of color addresses.

The output from CLUT 100 is a serial binary data stream of logic 1's and 0's at the 18-bit word rate on digital video bus 30. The one bit per eighteen word rate represents an 18:1 data compression ratio, thereby facilitating subsequent computations.

The serial binary data stream from CLUT 100 is fed into a filter lookup table ("FLUT") 102. FLUT 102 has a 16-bit address space and contains 65,536 addressable memory locations. The address for FLUT 102 is formed by shifting the serial binary data stream from CLUT 100 into a 16-bit shift register 104. A 16-bit output bus 105 from shift register 104 forms the address for FLUT 102 and consists, at any given time, of the 16 previous data states shifted into 16-bit shift register 104 from CLUT 100. Each bit received from CLUT 100 corresponds to a sequential 18-bit word on digital video bus 30, and each sequential 18-bit word corresponds to an incremental (pixel sized) location along inspection zone 22 on conveyor belt 18 (FIG. 1). The number of sequential 18-bit words generated as a result of each scan of inspection zone 22 by camera 24 depends on the number of transducers in each CCD array of camera 24.

FLUT 102 performs a digital filtering operation on the binary data stream. The filter function to be performed is selectable by the operator via light-pen 48 from VGA display 46. Control computer 44 sends the selected filter data to FFE 32 via dual port interface 50, system bus 12, and a dual port interface 106 in FFE 32. Preferably there are seven filter selections including a first selection that does nothing to the binary data stream, a second selection that removes all single 1's and trailing 1's in a group of 1's, and a third selection that removes all single 1's and all grouped pairs of 1's.

To filter the sequential binary data stream at the output of CLUT 100 in the manner described above, the filtering operation for any given address of FLUT 102 has to be based on data states preceding and subsequent to the data bit being examined. This causes delay in the filtering process because bits must be shifted into the address of FLUT 102 before a properly filtered output can be generated. This delay is inherent in the manner in which FLUT 102 is addressed and programmed.

By convention, the most recent data bit is designated the most significant bit (MSB) of the FLUT 102 address, the 16th prior bit is designated the least significant bit (LSB), and the 8th bit in the sequence is designated the bit being "filtered." In this manner FLUT 102 addresses filter data with "knowledge" of 8 prior bits and the 7 subsequent bits. If the operator selects a filter that removes a single leading "1" and a single trailing "1" from a group of three 1's, the address will have a 1 stored at that memory location, as shown below.

FLUT Address: 0000001110000000
MSB 8 LSB

The output of FLUT 102 is also a sequential binary data stream with a delay of 8 bits with respect to the binary data stream from CLUT 100. This delayed, filtered binary data stream is written into an image memory 108 on FFE 32. FFE 32 also includes a graphic signal processor ("GSP") 110 such as type 34010 available from Texas, Instruments, Inc., Dallas, Tex. Image memory 108 is within the address space of GSP 110, which forms the "image" of the filtered serial data by storing the data as a raster of line scans. GSP 110 then inspects image memory 108 for horizontal and vertical groupings of 1's that delineate defects 26 in items 16 being scanned by camera 24.

In particular, each line of data in image memory 108 is traversed by GSP 110 under control of a program stored in a program memory 112. The program causes GSP 110 to search image memory 108 for contiguous horizontal groupings of 1's. When such a grouping is found, the minimum and maximum X-coordinate values of the leading and trailing edge of the grouping are stored in a defect list in program memory 112 and are assigned a defect number. The area (number of 1's) for that defect is recorded by storing the number of contiguous 1's in the grouping. Subsequent groups of 1's on the same line are treated alike and assigned the next sequential defect number in the defect list.

The searching process is repeated for subsequent horizontal lines in image memory 108. The $X_{MIN}$ and $X_{MAX}$ values of the subsequent line are compared to those in the defect list and where an overlap occurs, the grouping in the subsequent line is assigned the same defect number. Where overlap occurs and the grouping in the subsequent line has a larger $X_{MAX}$ or a smaller $X_{MIN}$, the defect list values for $X_{MIN}$, $X_{MAX}$, $Y_{MIN}$, and $Y_{MAX}$ are updated. The corresponding defect area is also incremented by adding the number of 1's in the grouping of the subsequent line to the area number for the previous line. When the process is completed, the defect list contains the minimum and maximum X- and Y-coordinate values inside of which lie the defects and the areas of the defects. The minimum and maximum X- and Y-coordinate values also form a "defect-bounding box" that surrounds each defect. The geometric centers ("centroids") of the defect-bounding boxes are computed as $(X_{MIN}+X_{MAX})/2$ and $(Y_{MIN}+Y_{MAX})/2$. A preferred format for the defect list is:

| DEFECT | $X_{MIN}$ | $X_{MAX}$ | $Y_{MIN}$ | $Y_{MAX}$ | AREA (defect) |
|---|---|---|---|---|---|
| 1 | | | | | |
| 2 | | | | | |
| . | | | | | |
| . | | | | | |
| . | | | | | |
| n | | | | | |

When the defect list is completed, GSP 110 computes a defect centroid for each item in the defect list and builds a defect centroid list. A defects ready interrupt signal 114 is generated by GSP 110 to alert bus master computer 14 that the defect centroid list is ready. Bus master computer 14 then reads the defect centroid list from program memory 112 via dual port interface 106 and maps the defect centroid X- and y-coordinate values into ejector patterns for subsequent transmittal to defect removal driver 34. Defect size (area) limits are selected by the operator via light-pen 48. Selected sizes are compared by GSP 110 with the defect areas listed in the defect list to determine which defects are sufficient large to warrant computing and listing defect centroids for sending to bus master computer 14 and mapping into ejector patterns.

If defects meeting multiple color and size criteria are to be removed, a separate FFE 32 is used for each combination of defect color and size. For example, FFE board 32A detects small black defects, FFE board 32B detects larger brown defects, FFE board 32C detects green stem-sized defects, and FFE board 32D detects yellow soft-center sized defects.

Each FFE board 32 locates, lists, and reports the centroids of defects scanned into its own image memory 108. Each image memory 108 contains 128 scan lines of memory with 1024 bits per line. Defective colors in image memory 108 are preferably represented by a logic "1" bit and acceptable colors are represented by a logic "0" bit. Alternately, the opposite logical sense could be used.

FFE boards 32 also contain a set of bits-per-line counters 116 (one for each scan line) for counting the number of defect bits in each scan line of image memory 108. Before GSP 110 processes bits in any scan line, the program reads the bits-per-line counter 116 for the particular scan line and ignores the scan line if the number of defect bits does not exceed a predetermined number.

Contention between the FFE hardware and FFE program must be resolved because FLUT 102 will be writing new scan line data to image memory 108 while the GSP 110 program is processing old scan line data. To avoid contention, image memory 108 is divided into frames. GSP 110 is programmed so that FLUT 102 and GSP 110 are never accessing scan lines in the same frame at the same time. Furthermore, FLUT 102 is designed to send a "new-frame" interrupt signal to GSP 110. Using this interrupt signal, the GSP program knows when to access the next frame of data. GSP 110 also notifies the program when it must abandon a previous frame of data. The number of lines in a frame is programmable.

Alternatively, the defect finding program can process data in image memory 108 on a line-by-line basis because only two scan lines are needed in image memory at any one time. While GSP 110 is processing one scan line, FLUT 102 is writing to the other. In this case, GSP 110 is programmed to generate a "new-frame" interrupt signal on every scan line and the frame size is set to "one." For any scan line, when a defect has been located, the defect X-, Y-coordinate location is written to dual port memory 106. For every 64th scan line, the GSP 110 is programmed to generate defects ready interrupt signal 114.

Another contention must be resolved between bus master computer 14 and FFE 32 at dual port interface 106. In particular, bus master computer 14 cannot receive a defect centroid list from dual port interface 106 while GSP 110 is adding new defect centroids to the same list. To prevent data collisions, dual port interface 106 is divided into two halves. Defects ready interrupt signal 114 also informs master computer 14 which half of dual port interface 106 to access. GSP 110 then uses the other half to write the next defect centroid list. In operation, GSP 110 "ping-pongs" between the two halves of dual port interface 106.

One particular embodiment of this invention is directed to detecting hole-shaped defects such as those found in sliced pickles, donuts, cookies, and pineapple slices. With reference to FIGS. 1 and 2, the preferred hardware implementation includes a hole-FFE 32A' that is programmed to detect the color of entire items 16 against a contrasting background color such as that of conveying belt 18. Items are detected by detecting everything that is not substantially background-colored. Hole-FFE 32A' is a differently programmed version of the defect-FFE boards 32 already described. Holes detected within items have the same color as conveyor belt 16 and are, therefore, not ordinarily distinguishable from conveyor belt 16. However, background color detected inside the X-, Y-coordinate limits of items 16 can be distinguished from the same color detected outside the X-, Y-coordinate limits of item 16. This distinguishing feature is used as the basis for locating hole-shaped defects in items 16 as described below.

Hole-FFE 32A' builds a hole list in generally the same manner that defect-FFEs 32 build defect lists. The $X_{MAX}$-, $X_{MIN}$-, $Y_{MAX}$-, $Y_{MIN}$-coordinate limits of each item 16, as opposed to each defect, are included in the list. As a convention, the X-coordinate corresponds to the scanning direction for line scan camera 24, and the Y-coordinate represents the direction in which items 16 are moved past camera 24. The term $Y_{MAX}$ is preferably not more than 64 scan lines greater than the term $Y_{MIN}$. The number 64 is another convention, and the only limitation on $Y_{MAX}$ is that it correspond to less than the distance between inspection zone 22 and the ejector modules 38.

Figure 3A:
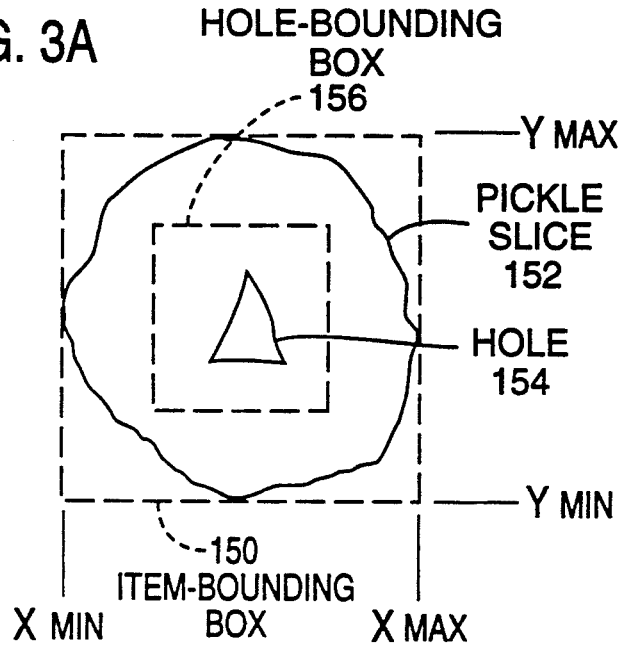
FIG. 3A is a plan view of a defective pickle slice showing a bounding box for the pickle slice and a bounding box for a hole in the pickle slice.

FIG. 3A shows these coordinate limits defining an item-bounding box 150 around an exemplary pickle slice 152 having a hole 154. The centroid of item-bounding box 150 is calculated as the average of the respective X- and Y-coordinate limits of the bounding box:

$$X_{CENTROID}=(X_{MAX}+X_{MIN})/2$$

$$Y_{CENTROID}=(Y_{MAX}+Y_{MIN})/2$$

Alternatively, the centroid may be determined by summing the individual coordinate positions representing an item inside item-bounding box 150 and dividing the sum by the number of such defect coordinates:

$$X_{CENTROID}=\Sigma_i X_N/N$$

$$Y_{CENTROID}=\Sigma_i Y_N/N.$$

Figure 3B:
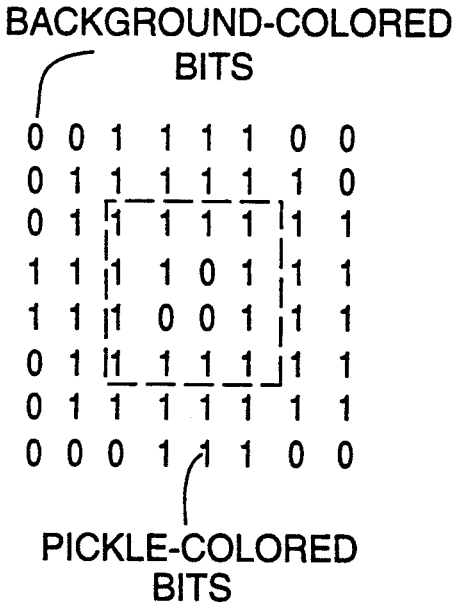
FIG. 3B is a bit-level representation of the pickle slice having the hole as shown in FIG. 3A.

Based upon a user-determined percentage, hole-FFE 32A' calculates a hole-bounding box 156 that is scaled down from the coordinates of item-bounding box 150. Hole-FFE 32' then calculates the number of background-colored bits within hole-bounding box 156. FIG. 3B shows a bit-level representation of "background-colored" and "pickle-colored" bits as they would be written into image memory 108 of hole-FFE 32A'. Hole 154 is shown to contain three background-colored bits within the area bounded by hole-bounding box 156. The calculation of the number of background-colored bits within hole-bounding box 156 involves incrementally increasing a number stored in program memory 112. If the number is greater than a predetermined threshold number selectable by the user, hole-FFE 32A' will transmit the centroid coordinates of item-bounding box 150 to bus master computer 14. The information representing hole-bounding box 156 and the number of item bits therein is stored in program memory 112 on hole-FFE 32A' as the hole list:

| HOLE | $X_{MIN}$ | $X_{MAX}$ | $Y_{MIN}$ | $Y_{MAX}$ | AREA (item) |
|---|---|---|---|---|---|
| 1 | | | | | |
| 2 | | | | | |
| . | | | | | |
| . | | | | | |
| . | | | | | |
| n | | | | | |

Prior to completing the hole list calculation set forth above, hole-FFE 32A' makes a preliminary determination of the overall size of pickle slice 152 based upon the area of pickel slice 152. If the overall size is less than a predetermined threshold, hole-FFE 32A' does not perform the hole analysis. The rationale is that it is not necessary to search for holes in "fragments" of whole pickle slices. In practice, most fragments of pickle slices fall through a pre-selection mesh before delivery to conveyor belt 18.

The preferred method whereby hole-shaped defects can be detected in items can be summarized as follows:

Step 1: Determine an item-bounding box 150 around each item 16.

Step 2: Find the centroid of item 16.

Step 3: Establish a hole-bounding box 154 within item-bounding box 150. Hole-bounding box 154 is a linearly scaled-down version of item-bounding box 150 (i.e., a percentage) of a size selected by the user. Hole-bounding box 154 assures that the subsequent search for background-colored bits occurs inside the boundaries of item 16. If hole-bounding box 154 is too small, some holes will not be detected.

Step 4: Accumulate the number of background-colored bits inside hole-bounding box 154.

Step 5: Compare the number of background-colored bits inside hole-bounding box 154 to a threshold value.

Step 6: Whenever the number of background-colored bits is greater than the threshold value, communicate the centroid of item-bounding box 150 to bus master computer 14 for ejection.

When hole-FFE 32A' is used in combination with defect finding FFEs 32, some of items 16 may be found to contain holes and/or defects. The X- and Y-coordinates of such a defect will be located within the item-bounding box 150 coordinates for the corresponding item. Bus master computer 14 receives defect lists from FFEs 32 and hole lists from hole-FFE 32A', but, when a defect is associated with an item detected by hole-FFE 32A', bus master computer 14 calculates ejector patterns for defect removal driver 34 based on centroids calculated from item-bounding box 150 data. In a case where multiple defects and/or holes are detected in a single item, only a single centroid-based ejector pattern datum is calculated.

It will be obvious to those having skill in the art that many changes may be made to the details of the above-described embodiments of this invention without departing from the underlying principles thereof. Accordingly, it will be appreciated that this invention is applicable also to inspection and sorting applications other than those relating to food products. The scope of the present invention should, therefore be determined only by the following claims.

I claim:

1. A method of detecting an item having a hole through which background colors are detectable as the item travels through a medium characterized by one or more of the background colors, comprising the steps of:

scanning the medium to produce a background signal that indicates the presence of a background color and an item signal that indicates the absence of a background color, the absence of background color representing the presence of an item;

storing in image memory locations the relative position coordinates of the background signals and the item signals representative of an image of the item scanned;

bounding with an item-bounding box the image memory locations containing the item signals, producing an identifying code identifying the item-bounding box;

placing a hole-bounding box within the item-bounding box; and sending the identifying code to a sorting processor upon a determination that the number of background signals stored inside the hole-bounding box is at least a predetermined number.

2. The method of claim 1 in which the item travels on a conveyor belt that provides the medium with a background that has the one or more background colors.

3. The method of claim 1 in which the medium comprises air.

4. The method of claim 1 in which the item-bounding box has a centroid, and the identifying code includes the centroid.

5. The method of claim 1 in which the item-bounding box has a item size and the hole-bounding box has a hole size, the hole size being a user-definable proportion of the item size.

6. The method of claim 1 in which the item has an item range of colors and the one or more background colors of the medium have a range of colors substantially nonoverlapping with the range of item colors.

7. An apparatus for detecting an item having a hole through which background colors are detectable as the item travels through a medium characterized by one or more of the background colors, comprising:

a scanning camera scanning the medium to produce a background signal that indicates the presence of a background color and an item signal that indicates the absence of a background color, the absence of background color representing the presence of an item;

an image memory storing at a set of relative coordinate storage locations the background signals and the item signals representative of an image of the item scanned;

a signal processor implemented to bound with an item-bounding box the storage locations containing the item signals to produce an identifying code identifying the item-bounding box, and to place a hole-bounding box within the item-bounding box; and a communications link sending the identifying code to a sorting processor upon determination that the number of background signals stored inside the hole-bounding box is at least a predetermined number.

8. The apparatus of claim 7 in which the item travels on a conveyor belt that provides the medium with a background that has the one or more background colors.

9. The apparatus of claim 7 in which the medium comprises air.

10. The apparatus of claim 7 in which the item-bounding box has a centroid, and the identifying code includes the centroid.

11. The apparatus of claim 7 in which the item-bounding box has a item size and the hold-bounding box has a hole size, the hole size being a user-definable proportion of the item size.

12. The apparatus of claim 7 in which the item has an item range of colors and the one or more background colors of the medium have a range of colors substantially nonoverlapping with the range of item colors.

* * * * *